United States Patent [19]

Vickers et al.

[11] 4,120,108

[45] Oct. 17, 1978

[54] GUN STOCK COVERS

[76] Inventors: Charles K. Vickers; Patricia A. Vickers, both of 160 Friar La., McMurray, Pa. 15317

[21] Appl. No.: 809,906

[22] Filed: Jun. 24, 1977

Related U.S. Application Data

[63] Continuation-in-part of Ser. No. 669,199, Mar. 19, 1976, abandoned.

[51] Int. Cl.[2] ..... F41C 23/00

[52] U.S. Cl. ..... 42/74

[58] Field of Search ..... 42/74, 71 R, 73

[56] References Cited

U.S. PATENT DOCUMENTS

| | | | |
|---|---|---|---|
| 616,424 | 12/1898 | Rowley | 42/74 |
| 2,188,691 | 1/1940 | Rigandi | 42/74 |
| 2,451,473 | 10/1948 | Cooper | 42/74 |
| 3,368,811 | 2/1968 | Finney | 42/71 R |
| 3,553,878 | 1/1971 | Canon | 42/73 |
| 3,574,965 | 4/1971 | Seiger | 42/74 |
| 3,665,990 | 5/1972 | Hefner, Jr. | 42/74 |

*Primary Examiner*—Charles T. Jordan

*Attorney, Agent, or Firm*—Buell, Blenko & Ziesenheim

[57] ABSTRACT

The cover comprises a flexible pad which covers the comb of the gun stock and depends along both sides thereof, and is attached to the gun stock by quick connect-disconnect means. In one embodiment spacer means are affixed to the underside of the pad and positioned on top of the comb to adjust its height. In another embodiment the underside of the pad is bonded to a layer of flexible material which is smoother than the outside of the pad material and which slides easily on the gun stock. The separable fastener elements carried by the pad are yieldably attached thereto so that in recoil the gun stock slides within the pad and the gunner's cheek is not abraded thereby.

7 Claims, 3 Drawing Figures

GUN STOCK COVERS

Figure 1:
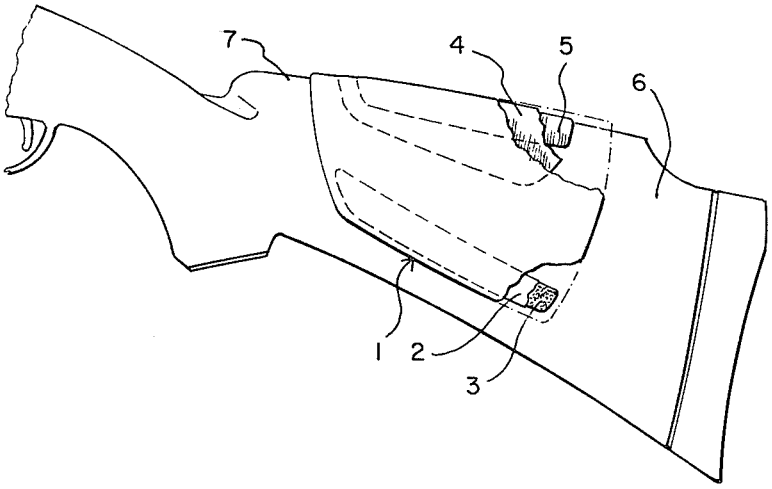

This application is a continuation-in-part of our application Ser. No. 669,199 filed Mar. 19, 1976, now abandoned.

This invention relates to gun stock covers. It is more particularly concerned with such a pad which is rapidly applied to and removed from the gun stock.

It is well-known to cover the stock of a gun with a pad or cushion to protect the cheek of the user and it is also well known to provide such a pad with insert means to raise the comb of the stock or, in other words, the drop of the gun. An example of such a device is disclosed in U.S. Pat. No. 616,425, issued Dec. 20, 1898 to T. D. Rowley. The Rowley pad and others like it surrround the stock on both sides, and the edges of the pad are fastened together below the stock by lacing. It is therefore somewhat tedious to remove and refit the pad. The thickness of the pad, of course, raises the comb of the gun stock and, as Rowley discloses, the comb may be raised further by inserting a spacer between comb and pad.

The comb height is of critical importance to a marksman, particularly one using a shot gun. The firing practice generally favored is to rest the cheek firmly on top of the comb and against the stock with the gun stock pulled into the shoulder pocket. This fixes the position of the eye with respect to the gun sights. However, trap shooting, for instance, requires a somewhat different eye position than hunting and skeet shooting, and still other positions are optimum for high rise targets and long range handicap shooting. This results because the shot pattern should impact at the point of aim for only one of the types of shooting mentioned; the others require pattern centers above the point of aim in different amounts. Thus, it would be highly advantageous for gunners to adjust the comb height in accordance with the nature of the targets, but that adjustment has not been readily made prior to our invention to be described.

When the cheek of the gunner is rested firmly against the gun stock, the recoil of the gun after firing tends to abrade the cheek. It is well known to affix cushions or pads of various sorts to a gun stock to lessen the recoil impact. Examples of such pads are disclosed in U.S. Pat. Nos. 2,188,691 to J. R. Rigandi dated Jan. 30, 1940 and 2,451,473 to E. G. Cooper, dated Oct. 19, 1948. The foundation pieces of the devices of both of those patents surround the stock on both sides and in some embodiments its end, and are fastened together below the stock by lacing as described by Rowley above mentioned, or by other means. Those devices therefore, are not readily removable and they are not very effective in reducing abrasion of the gunner's cheek.

It is a principal object of our invention to provide means for rapidly adjusting the comb height of a gun stock and/or absorbing gun recoil. It is another object to provide such means which are attached to a gun stock without marring it. It is still another object to provide such means that may be rapidly attached or detached from a gun stock. Other objects of our invention will appear in the course of the description thereof which follows.

Our device comprises, briefly, a flexible pad which covers the comb of the gun stock and depends along both sides thereof, and quick connect-disconnect means attaching the lower edges of the pad to the gun stock.

These means are preferably mating separable fasteners of the type mechanically interacting by functional surfaces.

In one embodiment of our invention spacer means are affixed to the underside of the pad and positioned on top of the comb. In another embodiment the underside of the pad is bonded to a layer of flexible material which is smoother than the outside of the pad material and which slides easily on the gun stock. The separable fastener elements carried by the pad are yieldably attached thereto so that in recoil the gun stock slides within the pad and the gunner's cheek is not abraded thereby.

Embodiments of our invention presently preferred by us are illustrated in the attached figures, to which reference is now made.

Figure 2:
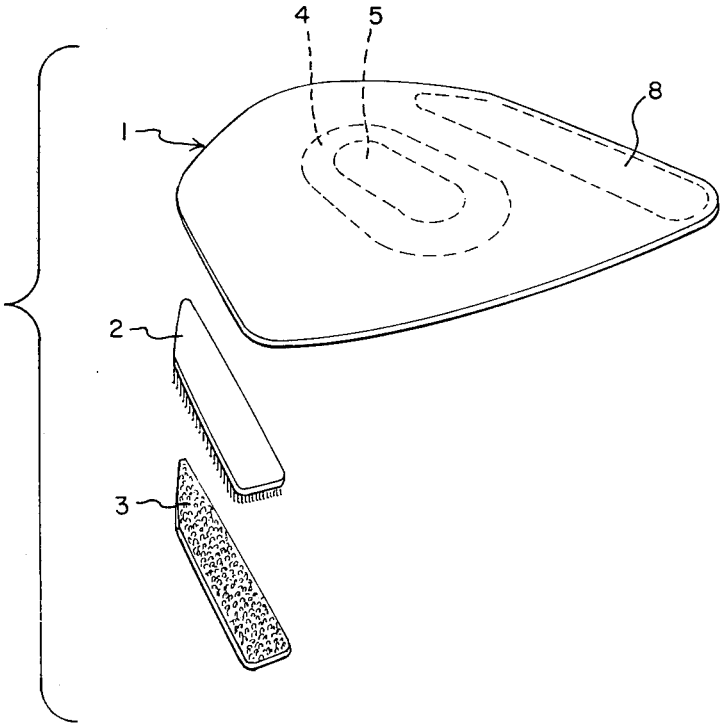
Figure 3:
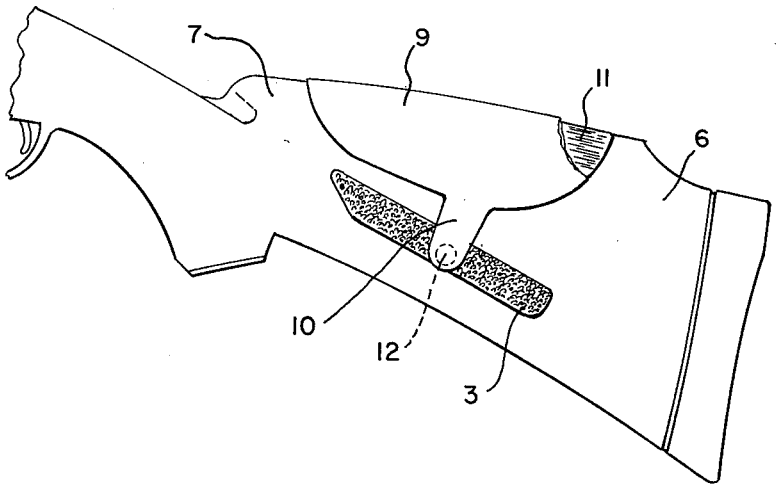

FIG. 1 is an elevation of a gun stock provided with the comb adjusting apparatus of our invention, partially cut away to show its construction, FIG. 2 is an exploded view of the comb adjusting apparatus of FIG. 1, FIG. 3 is an elevation of a gun stock provided with the recoil absorbing apparatus of our invention, partially cut away to show its construction.

In FIG. 1 a gun stock 6 has a comb 7. Over the latter is disposed a pad 1 of flexible material such as vinyl plastic, which is shaped so as to depend from comb 7 along both sides of gun stock 6. The lower edges 8 of pad 1 do not extend to the bottom of gun stock 6. To the underside of pad 1 is affixed a spacer comprising a layer of flexible material 4 of lesser extent than pad 1 and a still smaller layer of flexible material 5 affixed to layer 4. The width of layer 5 is approximately that of comb 7. The spacer layers are disposed so that layer 4 extends over comb 7 only enough to center layer 5 on top of the comb.

To the inside surface of pad 1 along lower edges 8 on both sides are affixed quick connect-disconnect elements 2. To gun stock 6 on each side is affixed a mating quick connect-disconnect element 3, which mates with corresponding element 2. These are best shown in FIG. 2. Elements 3 are preferably cemented to gun stock 6 with a thermoplastic adhesive which permits their removal from gun stock 6 without marring by merely heating them.

The quick connect-disconnect fasteners are preferably of the type mechanically interacting by functional surfaces, such as are disclosed in U.S. Pat. Nos. 2,717,437 of Sept. 13, 1955 and 3,009,235 of Nov. 21, 1961, both issued to G. DeMestral.

In one form, sold under the trademark "Velcro", the device comprises two layers of woven fabric of the velvet type in which loops have been cut to form hooks. The securing elements consist on the one part of numerous closely spaced plastic hooks and on the other part of numerous closely spaced loops. When hook and loop elements are pressed into face-to-face contact, the hooks catch into the loops and the two elements are retained firmly together until intentionally separated by pulling the two elements apart. Upon separation, the hooks flex open and disengage from the loops. After separation the hooks close up and return to their original hook shape. However, other types of quick connect-disconnect fasteners may be used, such as snap fasteners.

A gunner using a fire arm embodying our apparatus above described can rapidly change his comb height by selecting a pad with a spacer of the desired thickness and attaching it to his gun stock in the manner described above. The pad can be removed almost instantly and replaced with another with a spacer of different thickness by pulling off the first pad at the mating fasteners and applying a new one by placing it over the comb and pressing the fastener elements attached to either edge against the fastener elements affixed to the gun stock.

In FIG. 3 a gun stock 6 has a comb 7. Over the latter is disposed a pad of flexible material 9. This pad may be of the same material as pad 1 above described but, as shown, it does not extend as far down the sides of the gun stock as pad 1 except for a tab 10 on each side. To the underside of pad 9 is affixed a layer of flexible material 11 having a smooth undersurface which slides easily on gun stock 6. To the underside of each tab 10 at its end is affixed a quick connect-disconnect fastener element 12 which is of the same construction as element 2 above described, but of area no greater than the end of tab 10. As before, a mating quick connect-disconnect fastener element 3 is affixed to gun stock 6 on each side.

When a gun provided with our apparatus as above described and illustrated in FIG. 3 is fired, the recoil causes the stock 6 to slide with respect to layer 11. A limited amount of such movement is allowed by the yielding of tabs 10 by which pad 9 and its inner layer 11 are attached to fastener element 12. The abrasion of the gunner's cheek by pad 9 is reduced accordingly. The inner surface of layer 11 is made smoother than the outer surface of pad 9 so that the friction between layer 11 and gun stock 6 is less than the friction between pad 9 and the cheek of the gunner.

We have shown and described identical fastener elements 3 in both embodiments of our invention above described, as in this way different comb height adaptor pads 1 can be rapidly interchanged with each other and with recoil absorbing pads 9. If the latter form of pad alone is employed, a fastener element corresponding to element 3 but no larger than mating element 12 may be affixed to gun stock 6.

While we have separately described and illustrated embodiments of our invention, they may be combined. The recoil absorbing pad of FIG. 3 may also incorporate comb height adjusting spacers shown in FIG. 1.

In the foregoing specification we have described presently preferred embodiments of our invention; however, it will be understood that our invention can be otherwise embodied within the scope of the following claims.

We claim:

1. A cover for a gun stock including a comb comprising a pad of flexible material dimensioned to cover the comb and depend therefrom along both sides of the gun stock short of the bottom thereof, a layer of flexible material affixed to the under side of the pad, and mating quick connect-disconnect separable fastener elements, one such fastener element being affixed to each lower edge of the pad and one such mating fastener element being affixed to the gun stock on each side thereof.

2. Apparatus of claim 1 including a spacer of flexible material centrally affixed to pad and layer so as to space the pad above the comb.

3. Apparatus of claim 1 in which the mating quick connect-disconnect separable fastener elements comprise projecting elements of stiff filamentary material which interlock when fastener elements are pressed into face-to-face contact and separate when fastener elements are pulled apart.

4. Apparatus of claim 1 in which the pad is disposed so that the gunner's cheek rests against it when the gun is being sighted.

5. Apparatus of claim 4 in which the fastener elements affixed to the pad are yieldably affixed and in which the layer of flexible material bearing against the gun stock is smoother than the exterior surface of the pad, whereby on recoil of the gun, movement between gun stock and the layer of flexible material is greater than movement between the exterior surface of the pad and the cheek of the gunner.

6. Apparatus of claim 5 in which the friction between the exterior surface of the pad and the cheek of the gunner is greater than the friction between the gun stock and the layer of flexible material bearing against it.

7. Apparatus of claim 5 in which the fastener elements are yieldably affixed to the pad on tabs depending from the lower edges thereof.

* * * * *